US009751709B2

(12) United States Patent
Li et al.

(10) Patent No.: US 9,751,709 B2
(45) Date of Patent: Sep. 5, 2017

(54) CLEARANCE ADJUSTING APPARATUS, CLEARANCE ADJUSTING METHOD AND CONVEYANCE DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Kun Li, Beijing (CN); Wenjun Shen, Beijing (CN); Bin Wu, Beijing (CN); Xuequan Yu, Beijing (CN); Xiaodong Yu, Beijing (CN); Zhuyi Luo, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/094,455

(22) Filed: Apr. 8, 2016

(65) Prior Publication Data

US 2016/0340136 A1 Nov. 24, 2016

(30) Foreign Application Priority Data

May 22, 2015 (CN) ..... 2015 1 0268016

(51) Int. Cl.
*B65H 5/06* (2006.01)
*B65H 7/02* (2006.01)

(52) U.S. Cl.
CPC ..... *B65H 5/062* (2013.01); *B65H 7/02* (2013.01); *B65H 2404/1441* (2013.01);
(Continued)

(58) Field of Classification Search
CPC ..... B65H 5/062
(Continued)

(56) References Cited

U.S. PATENT DOCUMENTS 8,783,440 B2 7/2014 Yamazaki ..... B65G 13/02 198/457.02
2013/0168210 A1 7/2013 Yamazaki et al.
2016/0340135 A1* 11/2016 Lee ..... B65H 5/26

FOREIGN PATENT DOCUMENTS

CN 102147235 A 8/2011
CN 103101799 A 5/2013
(Continued)

OTHER PUBLICATIONS

First Office Action dated May 16, 2017 corresponding to Chinese application No. 201510268016.5.

*Primary Examiner* — Leslie A Nicholson, III
*Assistant Examiner* — Lester Rushin
(74) *Attorney, Agent, or Firm* — Nath, Goldberg & Meyer; Joshua B. Goldberg; Christopher Thomas

(57) ABSTRACT

The invention discloses a clearance adjusting apparatus, a clearance adjusting method and a conveyance device. The clearance adjusting apparatus is used for adjusting a clearance between two opposite rollers and comprises: a driver for driving the roller to move up and down, at least one of the rollers being movable relative to the other; and a controller that stores a predetermined clearance scope being connected with the driver for controlling the driver to drive the movable roller to move up and down, so that the clearance between the two rollers falls into the predetermined clearance scope.

19 Claims, 1 Drawing Sheet

(52) U.S. Cl.
CPC .... *B65H 2511/20* (2013.01); *B65H 2511/224* (2013.01); *B65H 2513/40* (2013.01); *B65H 2515/34* (2013.01); *B65H 2553/512* (2013.01); *B65H 2557/264* (2013.01)

(58) Field of Classification Search
USPC ..... 198/608, 611, 613, 626.3
See application file for complete search history.

(56) References Cited

FOREIGN PATENT DOCUMENTS

| | | | |
|---|---|---|---|
| CN | 203112191 | U | 8/2013 |
| CN | 102147235 | B | 11/2013 |
| CN | 103394441 | A | 11/2013 |
| CN | 103521399 | A | 1/2014 |
| JP | S61274761 | A | 12/1986 |

* cited by examiner

CLEARANCE ADJUSTING APPARATUS, CLEARANCE ADJUSTING METHOD AND CONVEYANCE DEVICE

FIELD OF THE INVENTION

The present invention relates to the field of display device manufacturing technology, and particularly relates to a clearance adjusting apparatus, a clearance adjusting method that uses the clearance adjusting apparatus for adjusting clearance and a conveyance device comprising the clearance adjusting apparatus.

BACKGROUND OF THE INVENTION

In the prior process, an etching liquid or gas will spray and flush a substrate which is conveyed through a wet etching device. In order to reduce vibration of the substrate during conveyance, a double-roller structure is usually desired to provide support for the substrate, so as to improve stability of the substrate during conveyance.

The double-roller structure of the prior art is designed as shown in FIG. 1, wherein a position of a lower roller 102 is fixed, while an upper roller 101 is movable up and down relative to the lower roller 102, and an upper roller shaft 103 and a lower roller shaft 104 are provided with shaft support brackets 105 at respective ends thereof. In the prior art, a clearance between two rollers is increased or reduced by increasing or reducing gaskets 106 between the shaft support brackets 105, or by raising or lowering a position of the upper roller 101 via adjusting an adjusting bolt 107 provided on the shaft support brackets 105 corresponding to the upper roller 101.

Currently, substrates tend to be diversified in size and thickness and the clearance between two rollers requires frequent adjustments during production according to the thickness of different substrates. The discussed prior adjustment methods mainly have the following defects: firstly, rollers disposed within the wet etching device makes it difficult to increase and decrease gaskets or to provide an adjusting bolt, and frequent manual operations within the device may easily pollute the inner circumstance, influence quality of products and waste human and material resources; secondly, in the prior art, the adjustment result is manually confirmed with a feeler gauge, which is low in precision and greatly different in personnel operations, thus the substrate can be easily damaged when the clearance between two rollers is abnormal, thereby causing product loss and reducing operation ratio of the device; further, the prior art cannot measure a pressure of the roller on the substrate, which may go against clearance adjustment and analysis after chippings occur.

SUMMARY OF THE INVENTION

The present invention has been accomplished in order to solve the above problems and it is an object thereof to provide a clearance adjusting apparatus, a clearance adjusting method and a conveyance device that can automatically adjust and monitor a clearance between two rollers, thereby reducing labor cost and prevent products from being damaged.

According to a first aspect of the invention, there is provided a clearance adjusting apparatus for adjusting a clearance between two opposite rollers, comprising:

a driver for driving the roller to move up and down, at least one of the two rollers being movable up and down relative to the other; and a controller that stores a predetermined clearance scope being connected with the driver for controlling the driver to drive the movable roller to move up and down, so that the clearance between the two rollers falls into the predetermined clearance scope.

According to a second aspect of the invention, there is provided the clearance adjusting apparatus according to the first aspect, wherein one of the two rollers is fixed and the other is movable, and the clearance adjusting apparatus further comprises a displacement measurer disposed at a side of the movable roller for measuring a displacement of the movable roller, the displacement measurer being connected with the controller to transmit measured displacement data to the controller; and the controller can determine whether the clearance between the two rollers falls into the predetermined clearance scope according to the received displacement data, and when the controller determines that the clearance between the two rollers does not fall into the predetermined clearance scope, the controller sends a control signal to the driver, which, after receiving the control signal, drives the movable roller to continue moving until the clearance between the two rollers falls into the predetermined clearance scope.

According to a third aspect of the invention, there is provided the clearance adjusting apparatus according to the second aspect, wherein the displacement measurer is a grating ruler comprising a scale grating that is stationary within the clearance adjusting apparatus, and a grating reading head that is connected with the movable roller and moves synchronously with the movable roller.

According to a fourth aspect of the invention, there is provided the clearance adjusting apparatus according to the second aspect, wherein the two rollers include a fixed lower roller and a movable upper roller disposed oppositely, and the upper roller is disposed on an upper roller shaft around which the upper roller is rotatable, and the lower roller is disposed on a lower roller shaft around which the lower roller is rotatable.

According to a fifth aspect of the invention, there is provided the clearance adjusting apparatus according to the fourth aspect, further comprising:

a sliding assembly comprising a slider and a linear guide rail for cooperation with the slider, wherein the slider is fixed at an end of the upper roller shaft and the linear guide rail is disposed vertically at a side of the slider opposite to the upper roller, the slider being movable up and down along the linear guide rail.

According to a sixth aspect of the invention, there is provided the clearance adjusting apparatus according to the fifth aspect, wherein the clearance adjusting apparatus comprises two groups of the sliding assemblies respectively disposed at two ends of the upper roller shaft.

According to a seventh aspect of the invention, there is provided the clearance adjusting apparatus according to the fifth aspect, wherein, the displacement measurer is a grating ruler comprising a scale grating that is stationary within the clearance adjusting apparatus, and a grating reading head that is disposed on the slider.

According to an eighth aspect of the invention, there is provided the clearance adjusting apparatus according to the fourth aspect, wherein the upper roller shaft is provided with two upper rollers, and the lower roller shaft is provided with two lower rollers.

According to a ninth aspect of the invention, there is provided the clearance adjusting apparatus according to the fourth aspect, wherein a piezoelectricity sensor is provided on a circumferential surface of the upper roller for measuring a pressure between the upper roller and a substrate to be conveyed, and the piezoelectricity sensor is connected with the controller to transmit measured pressure data to the controller.

According to a tenth aspect of the invention, there is provided the clearance adjusting apparatus according to the ninth aspect, wherein an O-shaped ring made of a piezoelectric material is provided on an outer surface of the upper roller to form the piezoelectricity sensor and is provided with a lead wire electrically connected with the controller.

According to an eleventh aspect of the invention, there is provided the clearance adjusting apparatus according to the fourth aspect, wherein the clearance adjusting apparatus comprises a transmission mechanism that includes an eccentric wheel and a first gear and a second gear being meshed with each other, the first gear is fixed on an output shaft of the driver; the transmission mechanism further includes a transmission shaft that passes through the center of the second gear, and a bracket for connecting the eccentric wheel fixed on an end of the transmission shaft and the upper roller shaft, and a rotation of the eccentric wheel is turned into ascending and descending movement of the upper roller shaft via a transmission function of the bracket.

According to a twelfth aspect of the invention, there is provided the clearance adjusting apparatus according to the eleventh aspect, wherein the transmission mechanism comprises two eccentric wheels and two brackets, the two eccentric wheels are respectively fixed on two ends of the transmission shaft and connected with two ends of the upper roller shaft via corresponding brackets thereof.

According to a thirteenth aspect of the invention, there is provided the clearance adjusting apparatus according to the first aspect, further comprising:

a human-computer interactive device that is connected with the controller, and through which an operator inputs the predetermined clearance scope to the controller, the human-computer interactive device comprises a computer or touch screen.

According to a fourteenth aspect of the invention, there is provided the clearance adjusting apparatus according to the first aspect, wherein the controller comprises a programmable logic controller.

According to a fifteenth aspect of the invention, there is provided the clearance adjusting apparatus according to the first aspect, wherein the driver comprises a motor.

According to a sixteenth aspect of the invention, there is provided a clearance adjusting method using the clearance adjusting apparatus for adjusting a clearance, comprising:

inputting a predetermined clearance scope to the controller; and controlling operation of the driver with the controller according to the predetermined clearance scope, so that the driver drives at least one of the two rollers to move up and down relative to the other, until the clearance between the two rollers falls into the predetermined clearance scope.

According to a seventeenth aspect of the invention, there is provided the clearance adjusting method according to the sixteenth aspect, wherein one of the two rollers is fixed and the other is movable, and the clearance adjusting apparatus further comprises a displacement measurer disposed at a side of the movable roller for measuring a displacement of the movable roller, the displacement measurer is connected with the controller to transmit measured displacement data to the controller;

the clearance adjusting method further comprises the following steps:

using the displacement measurer to measure a displacement of the movable roller in real time, and sending measured displacement data to the controller;

using the controller to determine whether the clearance between the two rollers falls into the predetermined clearance scope according to the received displacement data;

when the controller determines the clearance between the two rollers not falling into the predetermined clearance scope, using the controller to send a control signal to the driver; and using the driver to drive the movable roller to continue moving after receiving the control signal, until the clearance between the two rollers falls into the predetermined clearance scope.

According to a eighteenth aspect of the invention, there is provided the clearance adjusting method according to the seventeenth aspect, wherein the two rollers include a fixed lower roller and a movable upper roller disposed oppositely, and a piezoelectricity sensor is provided on a circumferential surface of the upper roller for measuring a pressure between the upper roller and a substrate to be conveyed, and the piezoelectricity sensor is connected with the controller to transmit measured pressure data to the controller;

the clearance adjusting method further comprises the following steps:

using the piezoelectricity sensor to measure a pressure between the upper roller and the substrate to be conveyed in real time, and sending measured pressure data to the controller; and using the controller to optimize the predetermined clearance scope according to the pressure data.

According to a nineteenth aspect of the invention, there is provided a conveyance device comprising the clearance adjusting apparatus.

In the clearance adjusting apparatuses according to the first and fourteenth aspects, the clearance adjusting method according to the sixteenth aspect and the conveyance device according to the nineteenth aspect, it can set different predetermined clearance scopes respectively according to different types of substrates, thereby realizing automatic adjustment of the clearance between two rollers and reducing labor cost.

In the clearance adjusting apparatuses according to the second, third and seventh aspects and the clearance adjusting method according to the seventeenth aspect, it can improve the precision of clearance measurement and effectively reduce the risk of products being damaged, thereby preventing a non-operation lost caused by chippings.

In the clearance adjusting apparatus according to the fourth aspect, it can prevent the substrate from suffering great vibration when being conveyed.

In the clearance adjusting apparatus according to the fifth aspect, it can ensure the upper roller to move vertically relative to the lower roller, thereby ensuring the precision of displacement measurement.

In the clearance adjusting apparatuses according to the sixth and twelfth aspects, it can enhance stability of the structure.

In the clearance adjusting apparatus according the eighth aspect, it can improve stability of the substrate when being conveyed.

In the clearance adjusting apparatuses according to the ninth to tenth aspects and the clearance adjusting method according to the eighteenth aspect, it can monitor the pressure on a surface of the substrate in real time and optimize and adjust the predetermined clearance scope via analyzing and processing the received pressure data, so as to reduce a risk of the substrate being damaged. In addition, when a chipping accident occurs, subsequent similar accidents may be prevented by tracking and analyzing the pressure data.

In the clearance adjusting apparatus according to the eleventh aspect, it can realize steadily turning a rotation movement of the driver into a linear movement of the upper roller.

In the clearance adjusting apparatus according to the thirteenth aspect, it can effectively improve an operator's operating experience.

BRIEF DESCRIPTION OF THE DRAWINGS

Accompanying drawings are provided for further understanding of this disclosure and constituting a part of the specification. Hereinafter, these drawings are intended to explain the disclosure together with the following specific embodiments, but should not be considered as a limitation of the disclosure.

REFERENCE SIGNS

Figure 1:
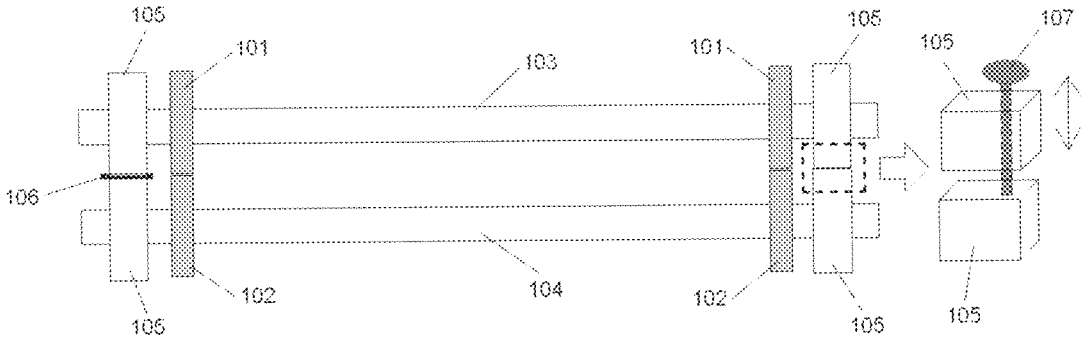
FIG. 1 is a schematic view illustrates the adjustment of the clearance between two rollers according to the prior art.

101—upper roller; 102—lower roller; 103—upper roller shaft; 104—lower roller shaft; 105—shaft support brackets; 106—gasket; 107—adjusting bolt; 201—driver; 202—controller; 203—displacement measurer; 204—slider; 205—linear guide rail; 301—scale grating; 302—grating reading head; 206—O-shaped ring; 207—eccentric wheel; 208—first gear; 209—second gear; 210—transmission shaft; 211—brack; 212—human-computer interactive device.

DETAILED DESCRIPTION OF THE EMBODIMENTS

Hereinafter, specific embodiments of the disclosure will be described in detail in conjunction with the accompanying drawings. It should be understood that the specific embodiments as set forth herein are merely for the purpose of illustration and explanation of the disclosure and should not be constructed as a limitation thereof.

According to one aspect of the invention, there is provided a clearance adjusting apparatus for adjusting a clearance between two opposite rollers, wherein at least one of the two rollers is movable up and down relative to the other. For instance, in FIG. 2, the clearance adjusting apparatus is used to adjust a clearance between an upper roller 101 and a lower roller 102 and at least one of the upper roller 101 and the lower roller 102 is movable up and down relative to the other.

The clearance adjusting apparatus comprises a driver 201 for driving the movable roller to move up and down and a controller 202. Herein, "the movable roller" refers to at least one of the upper roller 101 and the lower roller 102. The controller 202 that stores a predetermined clearance scope is connected with the driver 201 for controlling the driver 201 to drive the movable roller to move up and down, so that the clearance between the two rollers falls into the predetermined clearance scope.

The predetermined clearance scope is determined according to properties, such as thickness, material, of a substrate to be conveyed and practical production experience, and usually comprises a predetermined clearance value and an allowable error scope thereof.

Compared with the prior art, the invention uses the driver 201 to drive the roller, controls movement of the driver 201 by the controller 202 and can set different predetermined clearance scopes respectively according to different types of substrates, thereby realizing automatic adjustment of the clearance between two rollers, which greatly reduces desired workload due to frequent manual adjustments and labor cost, and improves adjustment precision.

The controller 202 of the invention includes a programmable logic controller and provides with, for example, a memory, arithmetic device and input and output interface therein, so that an operator may conveniently input a predetermined clearance scope to the controller 202. Alternatively, the driver 201 of the invention comprises a motor as a mechanical power source.

Further, in order to conduct quantitive management of the clearance between two rollers, one of the two rollers may be set as fixed and the other movable. Moreover, the clearance adjusting apparatus further comprises a displacement measurer 203 that is disposed at a side of the movable roller for measuring a displacement of the movable roller. The displacement measurer 203 is connected with the controller 202 to transmit measured displacement data thereto.

The controller 202 can determine whether the clearance between the two rollers falls into the predetermined clearance scope according to the received displacement data, and when determining the clearance between the two rollers not falling into the predetermined clearance scope, the controller 202 sends a control signal to the driver 201, which, after receiving the control signal, drives the movable roller to continue moving until the clearance between the two rollers falls into the predetermined clearance scope.

The clearance adjusting apparatus according to the exemplary embodiment of the invention further has a displacement measurer 203 for monitoring the clearance between two rollers in real time. Compared with the prior art, the invention can obviously improve the precision of clearance measurement. In addition, the controller 202 may adjust the driver 201 in time according to the received displacement data, thereby further improving the controlling precision, effectively reducing the risk of products being damaged and preventing a non-operation lost due to chippings.

The invention does not define specific forms of the displacement measurer 203, as long as it can measure a displacement of the roller in real time. For example, the displacement measurer 203 may be a grating ruler comprising a scale grating 301 and a grating reading head 302.

Wherein, the scale grating 301 is stationary within the clearance adjusting apparatus, and the grating reading head 302 is connected with the movable roller and can move synchronously with the movable roller.

Figure 2:
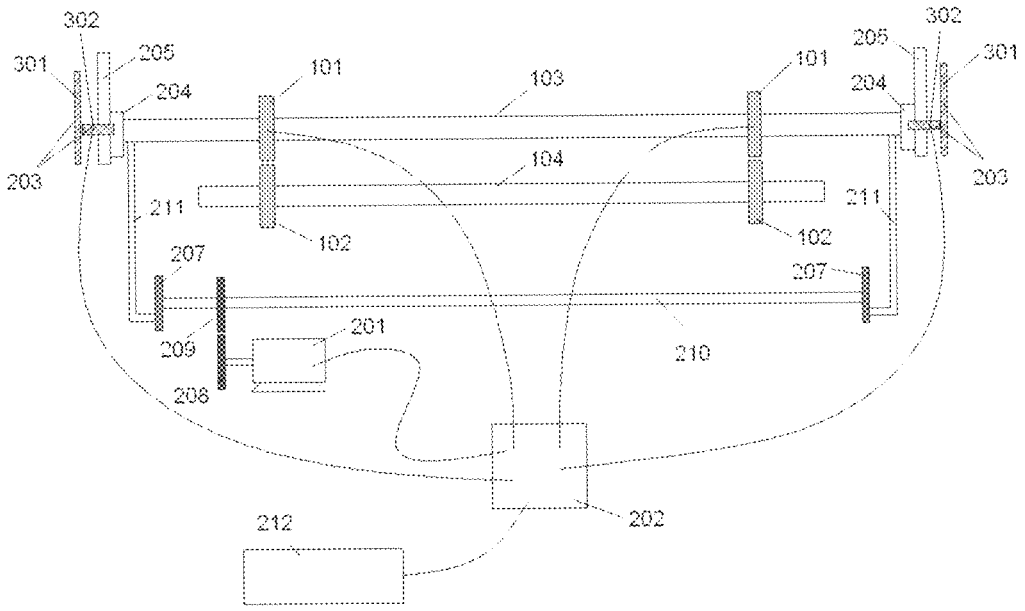
FIG. 2 is a schematic view illustrates a clearance adjusting apparatus according to the exemplary embodiment of the invention.

The measuring principle of the grating ruler is mainly based on the change of moire fringes between the grating reading head 302 and the scale grating 301 when the former moves relative to the latter. Since the grating ruler has been widely used, the description thereof is omitted Specifically, as shown in FIG. 2, the two rollers are upper roller 101 and lower roller 102 that are oppositely disposed, wherein the lower roller 102 is fixed and the upper roller 101 is movable up and down. The upper roller 101 is disposed on an upper roller shaft 103 around which the upper roller 101 is rotatable, and the lower roller 102 is disposed on a lower roller shaft 104 around which the lower roller 102 is rotatable. Usually, a substrate to be conveyed is placed between the upper roller 101 that prevents the substrate from suffering great vibration and the lower roller 102 that conveys the substrate.

In order to convey the substrate steadily, preferably, each upper roller shaft 103 is provided with two upper rollers 101 thereon, and each lower roller shaft 104 is provided with two lower rollers 102 thereon. It should be understood that the upper roller shaft 103 and the lower roller shaft 104 may further provide with more rollers to improve stability of the substrate during conveyance.

The clearance adjusting apparatus further comprises a sliding assembly including a slider 204 and a linear guide rail 205 for cooperation with the slider 204, wherein the slider 204 is fixed at an end of the upper roller shaft 103 and the linear guide rail 205 is disposed vertically at a side of the slider 204 opposite to the upper roller 101. The slider 204 is movable up and down along the linear guide rail 205 to ensure a vertical movement of the upper roller 101 relative to the lower roller 102, thus ensuring the precision of displacement measurement.

Preferably, as shown in FIG. 2, the clearance adjusting apparatus comprises two groups of sliding assemblies respectively disposed at two ends of the upper roller shaft 103 to improve the structural stability.

As discussed above, the displacement measurer 203 of the invention may be a grating ruler including a scale grating 301 and a grating reading head 302. Herein, the scale grating 301 is stationary within the clearance adjusting apparatus in order to precisely measure a displacement of the upper roller 101, and the grating reading head 302 is disposed on the slider 204 and moves with the slider 204 to realize measuring the displacement of the upper roller 101.

As discussed above, during the conveyance process, the substrate is placed between the upper roller 101 and the lower roller 102. Preferably, the upper roller 101 is provided with a piezoelectricity sensor on the circumferential surface thereof for measuring a pressure between the upper roller 101 and a substrate to be conveyed. Moreover, the piezoelectricity sensor is connected with the controller 202 to transmit measured pressure data to the controller 202.

Specifically, the piezoelectricity sensor is formed by pressure sensitive elements so that a pressure on the substrate at any point can be turned into an electrical signal that contains data information of the pressure on the substrate surface. The controller 202 analyzes and processes the received electrical signal and restores the pressure data, so as to monitor the pressure on the substrate surface in real time.

The clearance adjusting apparatus according to the exemplary embodiment of the invention further comprises a piezoelectricity sensor to monitor the pressure on the substrate surface in real time. By analyzing and processing the received pressure data, the predetermined clearance scope may be optimized and adjusted to reduce a risk of the substrate being damaged. In addition, when a chipping accident occurs, the clearance adjusting apparatus according to the exemplary embodiment of the invention may effectively prevent subsequent similar accidents from occurring by tracking and analyzing the pressure data.

Figure 3:
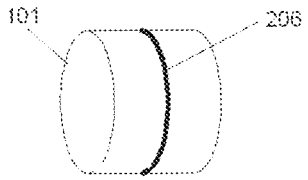
FIG. 3 is a structural schematic view illustrates an upper roller according to the exemplary embodiment of the invention.

According to the exemplary embodiment of the invention, as shown in FIG. 3, an O-shaped ring 206 that is made by a piezoelectric material is provided on an outer surface of the upper roller 101 to form the piezoelectricity sensor. Moreover, the O-shaped ring 206 is provided with a lead wire that is electrically connected with the controller 202 to transmit the pressure data measured by the piezoelectricity sensor to the controller 202.

Alternatively, a loop groove (not shown) around the outer surface of the upper roller 101 may be provided thereon and comprise an O-shaped ring 206 therein. It should be understood that, in this embodiment, the O-shaped ring 206 has a periphery that must be no lower than the outer surface of the upper roller 101, that is, the O-shaped ring 206 should project from, or at least be level with, the outer surface of the upper roller 101, so as to contact the substrate to be conveyed to measure the pressure thereon.

The clearance adjusting apparatus further comprises a transmission mechanism. As shown in FIG. 2, the transmission mechanism comprises an eccentric wheel 207 and a first gear 208 and a second gear 209 being meshed with each other, the first gear 208 is fixed on an output shaft of the driver 201; the transmission mechanism further includes a transmission shaft 210 that passes through the center of the second gear 209, and a bracket 211 for connecting the eccentric wheel 207 fixed on an end of the transmission shaft 210 and the upper roller shaft 103; and a rotation of the eccentric wheel 207 is turned into ascending and descending movement of the upper roller shaft 103 via a transmission function of the bracket 211, thereby realizing steadily turning a rotation movement of the driver into a linear movement of the upper roller.

It is necessary to explain that the above transmission mechanism is exemplary; the transmission mechanism of the invention may be realized by other manners, as long as it can realize the driver 201 driving the upper roller shaft 103 to move up and down vertically. For instance, the transmission mechanism may be a rack and pinion mechanism, wherein the pinion is fixed on the output shaft of the driver 201, and the rack is connected with the upper roller shaft 103. The driver 201 drives the pinion to rotate and the rotation of the pinion is turned into ascending and descending movement of the upper roller shaft 103 via a transmission function of the rack.

Preferably, as shown in FIG. 2, the transmission mechanism comprises two eccentric wheels 207 and two brackets 211, and the two eccentric wheels 207 are respectively fixed on two ends of the transmission shaft 210 and connected with two ends of the upper roller shaft 103 via corresponding brackets 211 thereof, so as to improve the structural stability.

The clearance adjusting apparatus further comprises a human-computer interactive device 212 that is connected with the controller 202, and through which an operator inputs a predetermined clearance scope to the controller 202. In the exemplary embodiment, the human-computer interactive device 212 comprises a device such as a computer or a touch screen. Instead of complicated programming input, the human-computer interactive device 212 enables the operator to conduct simple data input or touch operation, thereby effectively improving the operating experience of users.

According to another aspect of the invention, there is provided a clearance adjusting method using the clearance adjusting apparatus for adjusting a clearance, the clearance adjusting method comprising the following steps:

inputting a predetermined clearance scope to the controller 202 according to the properties, such as thickness and size, of the substrate; and controlling operation of the driver 201 with the controller 202 according to the predetermined clearance scope, so that the driver 201 drives at least one of the two rollers (here means the upper roller 101 and lower roller 102) to move up and down relative to the other, until the clearance between the two rollers falls into the predetermined clearance scope.

The invention uses the driver 201 to drive the roller, controls movement of the driver 201 by the controller 202 and sets different predetermined clearance scopes respectively according to different types of substrates, thereby realizing automatic adjustment of the clearance between two rollers, reducing labor cost and improving the adjustment precision.

In this exemplary embodiment, a predetermined clearance scope may be directly input to the controller 202, or, as shown in FIG. 2, be determined through a human-computer interactive device 212 and then sent to the controller 202 by the human-computer interactive device 212.

Further, one of the rollers is fixed and the other is movable. Taking FIG. 2 as an example, a position of the lower roller 102 is fixed and the upper roller 101 is movable up and down relative to the lower roller 102 to adjust the clearance between the two rollers. The clearance adjusting apparatus further comprises a displacement measurer 203 for measuring a displacement of the upper roller 101. The displacement measurer 203 is connected with the controller 202 to transmit the measured displacement data thereto.

The clearance adjusting method further comprises the following steps:

using the displacement measurer 203 to measure a displacement of the movable roller (here means the upper roller 101) in real time, and sending measured displacement data to the controller 202;

using the controller 202 to determine whether the clearance between the two rollers falls into the predetermined clearance scope according to the received displacement data;

when the controller 202 determines the clearance between the two rollers not falling into the predetermined clearance scope, using the controller 202 to send a control signal to the driver 201; and using the driver 201 to drive the movable roller (here means the upper roller 101) to continue moving after receiving the control signal, until the clearance between the two rollers falls into the predetermined clearance scope.

Providing a displacement measurer 203 makes the clearance adjusting apparatus of the invention form a feedback control system. The controller 202 further adjusts and controls movement of the driver 201 according to the received displacement data to make the clearance between the two rollers gradually approach, until equal to, the predetermined clearance value.

Moreover, compared with the prior art, by using the displacement measurer 203 to monitor the clearance between two rollers in real time, the present invention can remarkably improve the precision of clearance measurement, thereby effectively reducing a risk of products being damaged and preventing a non-operation lost caused by chippings.

Further, a piezoelectricity sensor is provided on a circumferential surface of the upper roller 101 for measuring a pressure between the upper roller 101 and the substrate to be conveyed, and the piezoelectricity sensor is connected with the controller 202 to transmit measured pressure data thereto.

The clearance adjusting method further comprises the following steps:

using the piezoelectricity sensor to measure a pressure between the upper roller 101 and the substrate to be conveyed in real time, and sending measured pressure data to the controller 202; and using the controller 202 to optimize the predetermined clearance scope according to the pressure data. The object of optimization here is to ensure the stability of the substrate to the best while reducing the risk of the substrate being damaged during conveyance.

By providing the piezoelectricity sensor, the invention can monitor the pressure on the substrate surface in real time, and by analyzing and processing the received pressure data, the predetermined clearance scope may be optimized and adjusted to reduce a risk of the substrate being damaged, thereby preventing cost lost due to product chippings.

According to yet another aspect of the invention, there is provided a conveyance device comprising the clearance adjusting apparatus. When the substrate is conveyed to pass a wet etching device or air-shower device by the conveyance device, the substrate has a higher stability when being flushed by an etching fluid or gas since the adjustment precision of the clearance between two rollers is higher and a state of the pressure on the substrate can be monitored in real time, thus it can effectively prevent production accidents from occurring.

It should be understood that the above embodiments are merely exemplary embodiments for the purpose of illustrating the principle of the invention, and the present invention is not limited thereto. Various modifications and improvements can be made by a person having ordinary skill in the art without departing from the spirit and essence of the invention. Accordingly, all of the modifications and improvements also fall into the protection scope of the invention.

The invention claimed is:

1. A clearance adjusting apparatus for adjusting a clearance between two opposite rollers in a direction perpendicular to the rollers' axis, comprising a driver for driving the rollers to move up and down in the direction perpendicular to the rollers' axis, at least one of the two rollers being movable up and down relative to the other in the direction perpendicular to the rollers' axis; and a controller that stores a predetermined clearance scope being connected with the driver for controlling the driver to drive at least one of the two rollers to move up and down in the direction perpendicular to the rollers' axis, so that the clearance between the two rollers in the direction perpendicular to the rollers' axis falls into the predetermined clearance scope.

2. The clearance adjusting apparatus according to claim 1, wherein one of the two rollers is fixed and the other is movable and the clearance adjusting apparatus further comprises a displacement measurer disposed at a side of the movable roller for measuring a displacement of the movable roller, the displacement measurer being connected with the controller to transmit measured displacement data to the controller; and the controller can determine whether the clearance between the two rollers falls into the predetermined clearance scope according to the received displacement data, and when the controller determines that the clearance between the two rollers does not fall into the predetermined clearance scope, the controller sends a control signal to the driver, which, after receiving the control signal, drives the movable roller to continue moving until the clearance between the two rollers falls into the predetermined clearance scope.

3. The clearance adjusting apparatus according to claim 2, wherein the displacement measurer is a grating ruler comprising a scale grating that is stationary within the clearance adjusting apparatus, and a grating reading head that is connected with the movable roller and moves synchronously with the movable roller.

4. The clearance adjusting apparatus according to claim 2, wherein the two rollers include a fixed lower roller and a movable upper roller disposed oppositely, and the upper roller is disposed on an upper roller shaft around which the upper roller is rotatable, and the lower roller is disposed on a lower roller shaft around which the lower roller is rotatable.

5. The clearance adjusting apparatus according to claim 4, further comprising:

a sliding assembly comprising a slider and a linear guide rail for cooperation with the slider, wherein the slider is fixed at an end of the upper roller shaft and the linear guide rail is disposed vertically at a side of the slider opposite to the upper roller, the slider being movable up and down along the linear guide rail.

6. The clearance adjusting apparatus according to claim 5, wherein the clearance adjusting apparatus comprises two groups of the sliding assemblies respectively disposed at two ends of the upper roller shaft.

7. The clearance adjusting apparatus according to claim 5, wherein, the displacement measurer is a grating ruler comprising a scale grating that is stationary within the clearance adjusting apparatus, and a grating reading head that is disposed on the slider.

8. The clearance adjusting apparatus according to claim 4, wherein the upper roller shaft is provided with two upper rollers, and the lower roller shaft is provided with two lower rollers.

9. The clearance adjusting apparatus according to claim 4, wherein a piezoelectricity sensor is provided on a circumferential surface of the upper roller for measuring a pressure between the upper roller and a substrate to be conveyed, and the piezoelectricity sensor is connected with the controller to transmit measured pressure data to the controller.

10. The clearance adjusting apparatus according to claim 9, wherein an O-shaped ring made of a piezoelectric material is provided on an outer surface of the upper roller to form the piezoelectricity sensor and is provided with a lead wire electrically connected with the controller.

11. The clearance adjusting apparatus according to claim 4, wherein the clearance adjusting apparatus comprises a transmission mechanism that includes an eccentric wheel and a first gear and a second gear being meshed with each other, the first gear is fixed on an output shaft of the driver; the transmission mechanism further includes a transmission shaft that passes through the center of the second gear, and a bracket for connecting the eccentric wheel fixed on an end of the transmission shaft and the upper roller shaft, and a rotation of the eccentric wheel is turned into ascending and descending movement of the upper roller shaft via a transmission function of the bracket.

12. The clearance adjusting apparatus according to claim 11, wherein the transmission mechanism comprises two eccentric wheels and two brackets, the two eccentric wheels are respectively fixed on two ends of the transmission shaft and connected with two ends of the upper roller shaft via corresponding brackets thereof.

13. The clearance adjusting apparatus according to claim 1, further comprising:

a human-computer interactive device that is connected with the controller, and through which an operator inputs the predetermined clearance scope to the controller, the human-computer interactive device comprises a computer or touch screen.

14. The clearance adjusting apparatus according to claim 1, wherein the controller comprises a programmable logic controller.

15. The clearance adjusting apparatus according to claim 1, wherein the driver comprises a motor.

16. A clearance adjusting method utilizing the clearance adjusting apparatus according to claim 1 for adjusting a clearance, comprising:

inputting a predetermined clearance scope to the controller; and controlling operation of the driver with the controller according to the predetermined clearance scope, so that the driver drives at least one of the two rollers to move up and down relative to the other, until the clearance between the two rollers falls into the predetermined clearance scope.

17. The clearance adjusting method according to claim 16, wherein one of the two rollers is fixed and the other is movable, and the clearance adjusting apparatus further comprises a displacement measurer disposed at a side of the movable roller for measuring a displacement of the movable roller, the displacement measurer is connected with the controller to transmit measured displacement data to the controller;

the clearance adjusting method further comprises the following steps:

using the displacement measurer to measure a displacement of the movable roller in real time, and sending measured displacement data to the controller;

using the controller to determine whether the clearance between the two rollers falls into the predetermined clearance scope according to the received displacement data;

when the controller determines the clearance between the two rollers not falling into the predetermined clearance scope, using the controller to send a control signal to the driver; and using the driver to drive the movable roller to continue moving after receiving the control signal, until the clearance between the two rollers falls into the predetermined clearance scope.

18. The clearance adjusting method according to claim 17, wherein the two rollers include a fixed lower roller and a movable upper roller disposed oppositely, and a piezoelectricity sensor is provided on a circumferential surface of the upper roller for measuring a pressure between the upper roller and a substrate to be conveyed, and the piezoelectricity sensor is connected with the controller to transmit measured pressure data to the controller;

the clearance adjusting method further comprises the following steps:

using the piezoelectricity sensor to measure a pressure between the upper roller and the substrate to be conveyed in real time, and sending measured pressure data to the controller; and using the controller to optimize the predetermined clearance scope according to the pressure data.

19. A conveyance device comprising the clearance adjusting apparatus according to claim 1.

* * * * *